United States Patent [19]

Scherrer

[11] Patent Number: 4,712,168

[45] Date of Patent: Dec. 8, 1987

[54] SPOTLIGHT BRACKET FOR A FALSE CEILING OR A FALSE WALL

[76] Inventor: Fernand Scherrer, 2, rue Georges Bizet, 68170 Rixheim, France

[21] Appl. No.: 905,780

[22] Filed: Sep. 9, 1986

[30] Foreign Application Priority Data

Sep. 13, 1985 [FR] France ..... 85 13619

[51] Int. Cl.[4] ..... F21S 1/02

[52] U.S. Cl. ..... 362/427; 362/150; 362/287

[58] Field of Search ..... 362/148, 287, 366, 371, 362/404, 426, 427, 150

[56] References Cited

U.S. PATENT DOCUMENTS 3,381,123 4/1968 Docimo ..... 362/366
4,232,361 11/1980 Kelsall ..... 362/404 X

FOREIGN PATENT DOCUMENTS 2098763 3/1972 France .
19860189 1/1960 Monaco .

*Primary Examiner*—Stephen F. Husar
*Attorney, Agent, or Firm*—McAulay, Fields, Fisher, Goldstein & Nissen

[57] ABSTRACT

A spotlight bracket for a false ceiling or false wall constituted by a stretched sheet hooked, along its edges, to a support fixed to the wall or to the ceiling, comprises two parts adjustable with respect to each other, namely an upper part fixed to the ceiling and a lower part adjustable in height and in inclination with respect to the fixed upper part. The upper part, in the form of a downwardly open fork-joint, comprises an upper horizontal web fixed to the ceiling or wall. This web is pierced with a hole for the passage of an electric cable and it is fast, at its two ends, with two vertical, downwardly extending arms. The adjustable lower part, which is also in the form of a fork-joint open upwardly, comprises a lower horizontal base plate fast with two opposite vertical arms extending upwardly and which tighten on the arms of the fixed upper fork-joint.

12 Claims, 3 Drawing Figures

SPOTLIGHT BRACKET FOR A FALSE CEILING OR A FALSE WALL

BACKGROUND OF THE INVENTION

The present invention relates to a spotlight bracket for a false ceiling or false wall constituted by a stretched sheet fastened, along its edges, to a support fixed to the wall or ceiling.

False ceilings are already known which comprise, on the one hand, a horizontal frame fixed to the upper part of the walls of a premises, this frame being formed by an outer longitudinal member itself constituted by butt-jointed sections and, on the other hand, a sheet stretched horizontally within this frame, this sheet being constituted by a sheet of plastics material or a fabric cloth. The sheet is maintained stretched due to the fastening, on the longitudinal member, of an edge integral with the sheet, forming to some extent a "harpoon", this edge presenting in cross section the form of a hook hooking on a shoulder of the longitudinal member.

Such known false ceilings are often used with a spotlight which is housed in a support or bracket fixed to the ceiling and/or to the wall between them and the sheet. Where a spotlight is mounted, the sheet is cut out so as to present an opening of diameter corresponding substantially to that of the spot, in order to allow the room in which the false ceiling or the false wall is mounted, to be illuminated.

SUMMARY OF THE INVENTION

The present invention relates to a spotlight bracket of particularly simple design which allows simple assembly whatever the implantation of the installation.

To that end, this spotlight bracket for use in a false ceiling or false wall constituted by a stretched sheet hooked, along its edges, to a support fixed to the wall or to the ceiling, comprises two parts adjustable with respect to each other, namely an upper part fixed to the ceiling and a lower part adjustable in height and in inclination with respect to the fixed upper part.

The stretched sheet may be connected to oppositely facing walls by any suitable conventional means. One such example of a suitable means is shown in Scherrer, U.S. Pat. No. 4,408,433. The aforesaid U.S. patent also refers to other prior art disclosing material or cloth maintained stretched inside a frame which is fixed to the top of the walls of a room.

BRIEF DESCRIPTION OF THE DRAWINGS

The invention will be more readily understood on reading the following description with reference to the accompanying drawings, in which.

DESCRIPTION OF THE PREFERRED EMBODIMENTS

Figure 1:
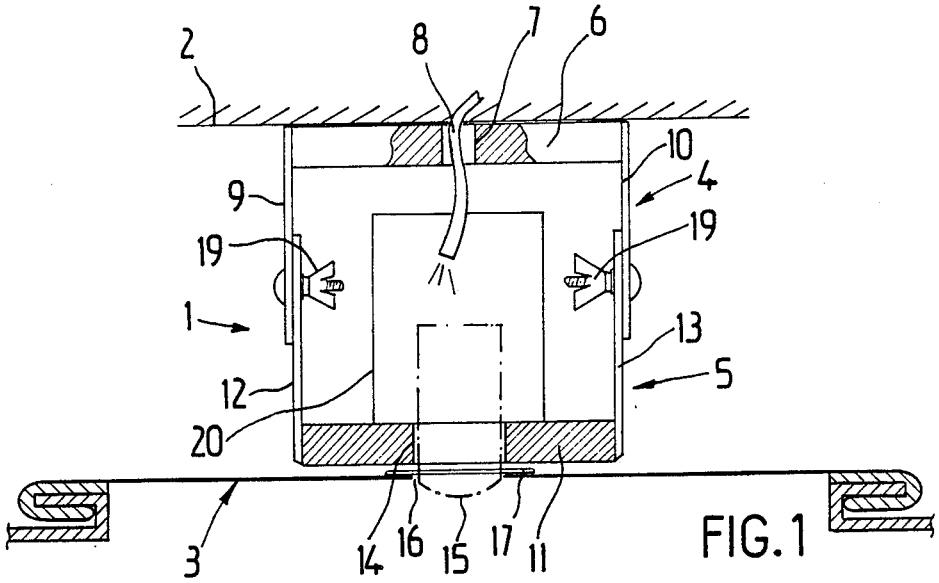
FIG. 1 is a view in vertical section of a spotlight bracket mounted above a stretched sheet constituting a false ceiling, according to the invention.

Referring now to the drawings, FIG. 1 shows a spotlight bracket 1 according to the invention which is disposed between a ceiling 2 and a stretched sheet 3 (schematically shown) extending horizontally and constituting a false ceiling. The spotlight bracket 1 according to the invention comprises two parts adjustable with respect to each other, namely an upper part 4 fixed to the ceiling 2 and a lower part 5 which is adjustable in height and inclination with respect to the fixed upper part 4. The upper part 4, in the form of a downwardly open fork-joint, comprises an upper horizontal web 6 which may be constituted by a piece of wood, this web 6 being fixed to the ceiling 2. The web 6 is pierced with a hole 7 for the passage of an electric cable 8. The web 6 is fast, at its two ends, with two vertical arms 9, 10 extending downwardly.

Figure 2:
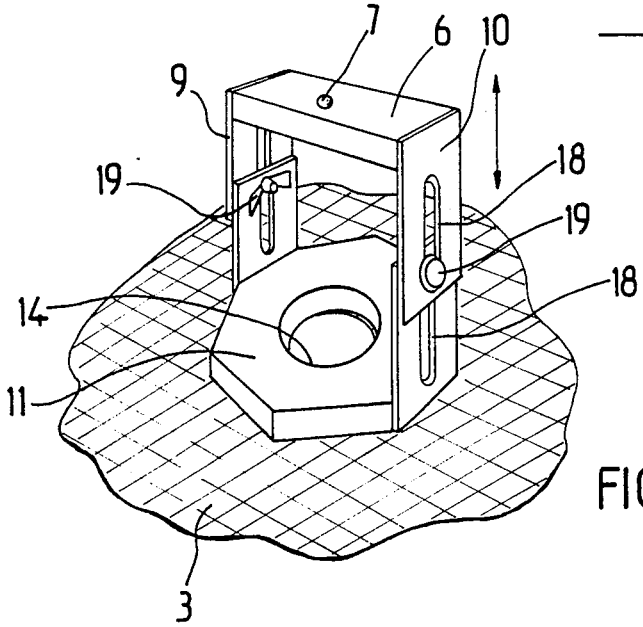
FIG. 2 is a view in perspective of the spotlight bracket of FIG. 1.

Furthermore, the adjustable lower part 5 which is also in the form of an upwardly open fork-joint, comprises a lower horizontal base plate 11 fast with two opposite vertical arms 12 and 13 extending upwardly and which tighten on arms 9,10 of the fixed upper fork-joint 4. The base plate 11 which may have a contour of any form, for example polygonal as shown in FIG. 2, is pierced at its centre with a hole 14 for the passage of a bulb 15 of the spotlight borne by bracket 1. The stretched sheet 3 is for its part also pierced with a hole 16, in registry with hole 14 of the base plate 11, and it preferably bears, on its upper face and around hole 16, a reinforcing washer 17 glued thereto.

The vertical arms 9, 12 on the one hand and 10,13 on the other hand, are assembled together so as to form assemblies adjustable in length and in inclination. Such adjustments are obtained thanks to the presence of oblong vertical slots 18 in arms 9,10,12,13 and of locking elements 19, for example of the butterfly nut type, engaged in the oblong slots 18.

Figure 3:
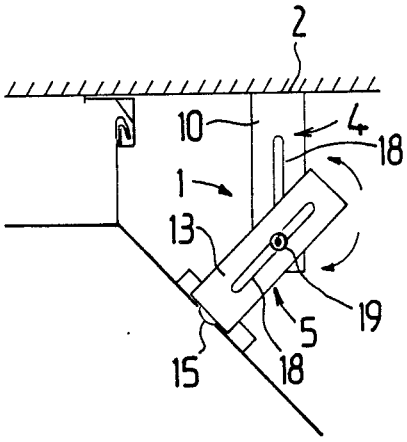
FIG. 3 is a view in elevation of the bracket used for assembling a spotlight in an inclined panel.

FIG. 3 illustrates the use of a spotlight bracket according to the invention when the spotlight is to be placed in an inclined plane. In that case, the lower part 5 of the bracket 1 is inclined by the appropriate angle with respect to the upper vertical part 4 fixed to ceiling 2.

A tube 20 may possibly be disposed inside the bracket 1, in abutment on plate 11 and surrounding the spotlight in order to form a screen with regard to the light radiated upwardly.

I claim:

1. Spotlight bracket for a false ceiling or a false wall, comprising:

upper and lower parts adjustable relatively to each other, said upper part being adapted for fixing to a ceiling or wall, and said lower part being adjustable both in height and in inclination relative to said upper part;

said lower part including a base plate having a hole pierced therethrough for the passage of a spotlight borne by the bracket.

2. The spotlight bracket according to claim 1, wherein said upper and lower parts are formed as an opening fork-joint.

3. The spotlight bracket according to claim 1, wherein said upper part comprises a downwardly opening fork-joint, including:

an upper horizontal web adapted to be fixed to the walls or ceiling, said web having a hole pierced therethrough for the passage of an electric cable; and a pair of spaced downwardly extending arms connected with said web.

4. The spotlight bracket according to claim 1, wherein said lower part comprises:

a lower horizontal base plate and two oppositely upwardly extending vertical arms.

5. The spotlight bracket according to claim 3, wherein said lower part comprises:

a lower horizontal base plate and two oppositely upwardly extending vertical arms.

6. The spotlight bracket according to claim 5, including means coupling the lower arms to said upper arms.

7. The spotlight bracket according to claim 6, including oblong vertical slots in each of said arms, and said coupling means including locking elements engaged in said oblong slots.

8. Spotlight bracket for a false ceiling or false wall constituted by a stretched sheet hooked, along its edges, to a support fixed to the wall or to the ceiling, wherein said spotlight bracket comprises:

two parts adjustable with respect to each other, namely an upper part fixed to the ceiling and a lower part adjustable in height and in inclination with respect to the fixed upper part, and said lower part includes a lower forked joint having a base plate; and said base plate being pierced at its center with a hole for the passage of a bulb of the spotlight borne by the bracket.

9. The spotlight bracket according to claim 8, wherein the upper part, in the form of a downwardly open fork-joint, comprises an upper horizontal web fixed to the ceiling or wall, this web being pierced with a hole for the passage of an electric cable and it is fixed, at its two ends, with two vertical, downwardly extending arms and, furthermore, the adjustable lower part, which is also in the form of a fork-joint open upwardly, comprises a lower horizontal base plate fixed with two opposite vertical arms extending upwardly and which connect with the arms of the fixed upper fork joint.

10. The spotlight bracket according to claim 9, wherein each of said arms include oblong vertical slots and locking elements engaged in each of the oblong vertical slots for locking the two fork-joints together and being movable in said oblong slots for adjustment of the two fork-joints by moving said locking elements in said oblong vertical slots.

11. Spotlight bracket for a false ceiling or false wall, comprising:

two parts adjustable with respect to each other, one of said parts having an upper part fixed to the ceiling or wall and the other of said parts being a lower part adjustable both in height and in inclination with respect to said upper part;

said upper part being in the form of a downwardly open fork-joint including an upper horizontal web fixed to the ceiling or wall, said web having a hole pierced therethrough for the passage through of a cable, and two vertically downwardly extending arms fixed to said web;

said adjustable lower part being in the form of a fork-joint open upwardly and comprising a lower horizontal base plate and two opposite vertically upwardly extending arms fixed with said base plate and connectable with the arms of said upper fork-joint; and said base plate being pierced at its center with a hole for the passage of a bulb for the spotlight.

12. The spotlight of claim 11, including locking elements for locking said arms together, and each of said arms having oblong vertical slots, said locking elements being received in said oblong slots for locking an individual arm of the lower part to one of the arms of said upper part.

* * * * *